US007821460B2

(12) United States Patent
Schillmeier et al.

(10) Patent No.: US 7,821,460 B2
(45) Date of Patent: Oct. 26, 2010

(54) TUNABLE PATCH ANTENNA OF PLANAR CONSTRUCTION

(75) Inventors: Gerald Schillmeier, München (DE); Frank Mierke, München (DE)

(73) Assignee: Kathrein-Werke KG, Rosenheim (DE)

( * ) Notice: Subject to any disclaimer, the term of this patent is extended or adjusted under 35 U.S.C. 154(b) by 94 days.

(21) Appl. No.: 11/889,842

(22) Filed: Aug. 16, 2007

(65) Prior Publication Data

US 2008/0042915 A1 Feb. 21, 2008

(30) Foreign Application Priority Data

Aug. 17, 2006 (DE) ..... 10 2006 038 528

(51) Int. Cl.
*H01Q 5/00* (2006.01)

(52) U.S. Cl. ..... 343/700 MS; 343/767; 343/825; 343/846

(58) Field of Classification Search ..... 343/745, 343/700 MS, 789, 825, 767, 846, 826
See application file for complete search history.

(56) References Cited

U.S. PATENT DOCUMENTS

| | | | | |
|---|---|---|---|---|
| 4,475,108 | A | 10/1984 | Moser | |
| 5,943,016 | A | 8/1999 | Snyder, Jr. et al. | |
| 6,028,561 | A * | 2/2000 | Takei | 343/767 |
| 6,034,644 | A * | 3/2000 | Okabe et al. | 343/767 |
| 6,188,369 | B1 * | 2/2001 | Okabe et al. | 343/767 |
| 6,462,712 | B1 | 10/2002 | Liang | |
| 6,639,558 | B2 * | 10/2003 | Kellerman et al. | 343/700 MS |
| 6,731,243 | B2 * | 5/2004 | Taira et al. | 343/700 MS |
| 6,756,942 | B2 * | 6/2004 | Heyde | 343/700 MS |
| 6,864,843 | B2 | 3/2005 | du Toit et al. | |
| 7,109,926 | B2 * | 9/2006 | du Toit | 343/700 MS |
| 2004/0201527 | A1 | 10/2004 | Hani et al. | |

FOREIGN PATENT DOCUMENTS

| | | |
|---|---|---|
| JP | 02150101 | 6/1990 |
| JP | 07094934 | 4/1995 |
| KR | 1020040072974 | 8/2004 |
| WO | WO 2007000749 A1 * | 1/2007 |

OTHER PUBLICATIONS

Munson, "Conformal Microstrip Antennas and Microstrip Phased Arrays", IEEE Transactions on Antennas and Propagation (1974).
Waterhouse et al., "Scan Performance of Infinite Arrays of Microstrip Patch Elements Loaded with Varactor Diodes", IEEE Transactions on Antennas and Propagation, pp. 1273-1280 (1993).

(Continued)

*Primary Examiner*—Douglas W Owens
*Assistant Examiner*—Jae K Kim
(74) *Attorney, Agent, or Firm*—Nixon & Vanderhye, PC

(57) ABSTRACT

An improved tunable antenna of planar construction is distinguished by the following features:

in plan view perpendicular to the effective surface (7), the electrically conductive structure (13, 113) completely or partially covers the effective surface (7), the electrically conductive structure (13, 113) is coupled and/or connected galvanically or capacitively or serially and/or with interposition with at least one electrical component (125) with the ground surface (3) and/or a chassis (B) located on a potential or ground.

29 Claims, 5 Drawing Sheets

OTHER PUBLICATIONS

Bokhari et al., "A Small Microstrip Patch Antenna With a Convenient Tunion Option", IEEE Transactions on Antennas and Propagation, vol. 44, pp. 1521-1528 (1996).

Daryoush et al., "Optically Tuned Patch Antenna for Phased Array Applications", EEE Transactions on Antennas and Propagation, pp. 361-364 (1993.

Ollikainen, J., et al., "Thin dual-resonant stacked shorted patch antenna for mobile communications," Electronics Letters vol. 35, No. 6 (Mar. 18, 1999).

Karmakar, N. C., "Shorting Strap Tunable Stacked Patch PIFA," IEEE Transactions on Antennas and Propagation, vol. 52, No. 11, pp. 2877-2884 (Nov. 2004).

Li, Ronglin, et al., "Development and Analysis of a Folded Shorted-Patch Antenna With Reduced Size," IEEE Transactions on Antennas and Propagation, vol. 52, No. 2, pp. 555-562 (Feb. 2004).

* cited by examiner

TUNABLE PATCH ANTENNA OF PLANAR CONSTRUCTION

FIELD

The invention relates to a tunable antenna of planar construction.

BACKGROUND AND SUMMARY

Patch antennas or so-called microstrip antennas have been known for a long time. They generally comprise an electrically conductive base surface, a dielectric carrier material arranged thereabove and an electrically conductive effective surface provided on the upper side of the dielectric carrier material. The upper effective surface is generally excited by a feed line extending transversely to the above-mentioned planes and layers. A coaxial cable is primarily used as the connection cable, the external conductor of which is electrically connected at a connection to the ground conductor, whereas the internal conductor of the coaxial cable is electrically connected to the effective surface located at the top.

A tunable microstrip antenna is known, for example, from U.S. Pat. No. 4,475,108. Integrated varactor diodes are used for frequency tuning in this patch antenna.

The use of varactor diodes for tuning an antenna is, however, basically also known from the publication IEEE "Transactions on antennas and propagation", September 1993, Rod B. Waterhouse: "Scan performance of infinite arrays of microstrip patch elements loaded with varactor diodes", pages 1273 to 1280.

The use of an optically controlled pin diode for frequency tuning is to be inferred, as known, from the prior publication IEEE "Transactions on antennas and propagation", September 1993, A. S. Daryoush: "Optically tuned patch antenna for phased array applications", 1986, pages 361 to 364. It is located in a plane of the patch surface and connects this to an additional coupling surface.

A very similar principle in this respect is basically also to be inferred from U.S. Pat. No. 5,943,016 A and U.S. Pat. No. 6,864,843 B2. The fact that introduced capacitors can be used for frequency tuning, which are, for example, incorporated in a patch, is known from U.S. Pat. No. 6,462,271 B2. A very complex mechanical tuning of the patch antenna may, however, also be inferred as known according to the prior publication IEEE "Transaction on antennas and propagation", S. A. Bokhari, J-F Züricher: "A small microstrip patch antenna with a convenient tuning option", November 1996, volume 48, pages 1521 to 1528.

Independently of the aforementioned patch antennas, multi-layer antennas of planar construction are also known, for example, as so-called "stacked" patch antennas. The possibility exists by means of such an antenna type to increase the band width of an antenna of this type or to ensure resonances in two or more frequency ranges. The antenna power gain can also be improved by antennas of this type.

The disadvantage in all previously known antenna arrangements of this type is the comparatively complex construction.

In the case of the previously known tunable antennas mentioned at the outset, a series of further components is generally necessary, which frequently even have to be directly integrated into the patch antenna. This generally requires not only a more complex development, but frequently also leads to an increase in the production costs.

Moreover, the previously known measures for achieving a tunable patch antenna can frequently also not be applied or transferred to conventional commercial ceramic patch antennas.

Finally, the above-mentioned previously known patch antennas also have the disadvantage that although they propose measures for frequency tuning, the proposed measures generally are not used for influencing the antenna pattern.

In comparison, we provide an improved tunable antenna of planar construction in which with comparative low outlay, not only frequency tuning, but primarily influencing of the antenna pattern is possible. In this case, it should preferably be possible to produce the antenna according to the invention using conventional commercial patch antennas.

Numerous advantages can be realized with the solution we provide.

Numerous advantages can be realized with the solution according to the invention.

An important advantage is produced in that influencing of the antenna pattern is possible with the antenna in a simple manner without a considerable outlay for additional components that are complicated to produce under certain circumstances, or even only a fine tuning, being necessary. Expensive special development or expensive production of additional parts is therefore avoided. However, the fact that in the scope of the invention, conventional commercial patch antennas, above all conventional commercial ceramic patch antennas can be used, emerges above all as an important advantage. When they are used in the scope of the invention, these do not have to be specially changed, but only completed in the context of the invention, producing a very economical overall construction. In this case, a frequency tuning and also an influencing of the antenna pattern are possible in the scope of the invention.

This is all the more surprising as the effective structure provided at the top on the patch antenna may have a longitudinal and transverse extension, which is greater, or which at least partially covers the edge of the effective surface located underneath and extends beyond the edge of the effective surface. It would be, in fact, to be expected in a case such as this, that the patch surface located at the top would disadvantageously influence the radiation pattern.

In a preferred embodiment of the invention, the metal structure located over the patch antenna may not only have a larger dimensioning in the longitudinal and transverse direction than the patch antenna located underneath. Deformations, openings etc. may at least also be configured in this metal structure. It is even possible for this metal structure to be divided into individual metal structural elements and/or regions, which are, for example, not connected to one another mechanically and/or electrically.

However, it is provided according to the invention that the metal structure is connected at least via an electrical connection to the ground surface, wherein this electrical connection may be a galvanic connection, a capacitive, serial and/or a connection, which is produced using electrical components and assemblies. Thus, in a preferred embodiment of the invention, the mentioned conducting or conductive structure may thus be connected by means of at least one electrical connection with the interposition of at least one electrical component to the ground surface. The electrical connection between the ground surface and the metal structure above the patch antenna, may thus take place as mentioned by direct contact or else by using any electrical components to thereby influence the property of the antenna. Possible examples here are varactor diodes, which represent a current-controlled capacitor. The patch antenna can therefore be tuned with regard to its frequency.

In a particularly preferred embodiment of the invention, the mentioned electrical connection between the metal structure and the ground surface is formed using carrying feet or support feet, on which an electrically conductive line is configured or which are themselves electrically conductive. The support feet or the at least one support foot is to this extent also formed from a metal structure, which, for example, can be connected in one piece with the metal structure above the patch antenna and may be produced merely by stamping and canting.

A plurality of support devices, which preferably simultaneously form the electrical connection to the ground surface optionally by using further electrical parts and components, are preferably provided in the peripheral direction of the metal structure. In the case of an n-polygonal design of the metal structure, n-feet are preferably provided. If the metal structure is rectangular or square, a corresponding, preferably electrically conductive support foot is thus preferably provided on each side, preferably in the central region. If the metal structure is divided into different part structures, a support foot, which is in turn preferably electrically conductive, is at least also preferably provided for each electrically conductive part structure.

Instead of the metal structures, one generally electrically non-conductive structure may also be provided, for example in the form of a dielectric body, which is covered with a correspondingly conductive layer.

In a development of the invention, the electrically conductive structure, in other words the so-called metal structure, is in this case formed, for example, by a copper surface on a printed-circuit board. The printed-circuit board could be metallized here, for example, on the upper side, whereas the electrical components (for example a varactor diode) are placed on the lower side. The carrying feet preferably provided as the carrying device could, for example, be connected to delimited areas of the upper printed-circuit board metallizing and be guided by means of through-platings to the electric components. Alternatively, the electrical components could also be located on the upper side of the printed-circuit board.

Although the patch antenna according to the invention also has a further additional conductive structure at a spacing with respect to the effective surface located at the top, this is nevertheless not a "stacked" patch antenna in the conventional sense, as, in stacked patch antennas, the patch surface provided at the top (in other words the additional effective surface in question) is not contacted via a conductive connection with the ground surface.

BRIEF DESCRIPTION OF THE DRAWINGS

Embodiments of the invention will be described in more detail below with the aid of the drawings, in which, in detail.

DETAILED DESCRIPTION OF EMBODIMENTS

Figure 1:
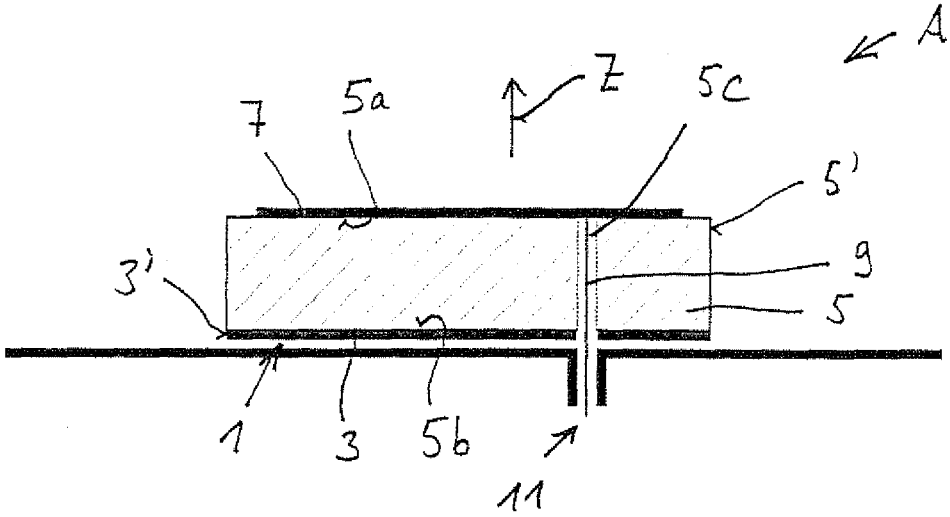
Fig. 1 (Prior Art)
FIG. 1 shows a schematic axial cross-sectional view through a conventional commercial patch antenna according to the prior art.
Figure 2:
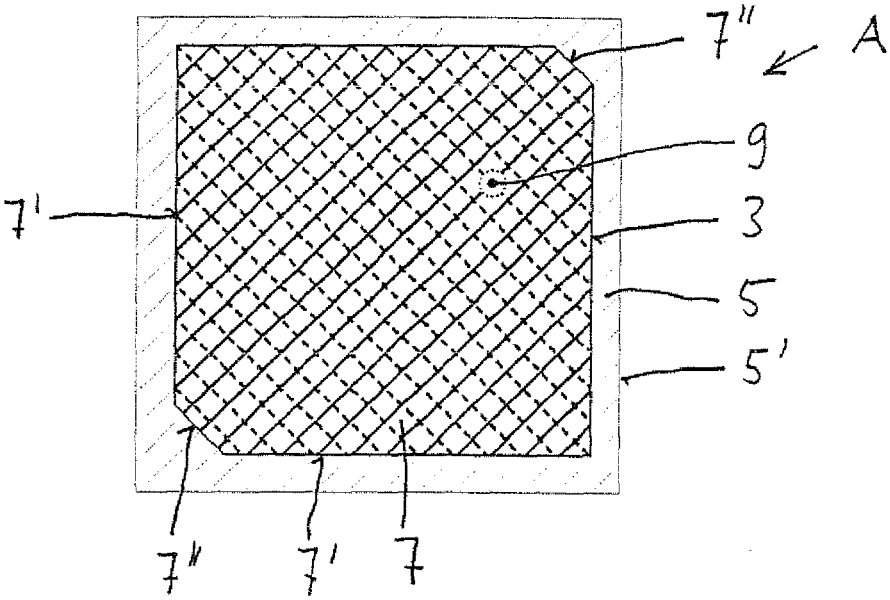
Fig. 2 (Prior Art)
FIG. 2 shows a schematic plan view of the patch antenna known according to the prior art according to FIG. 1.
Figure 3:
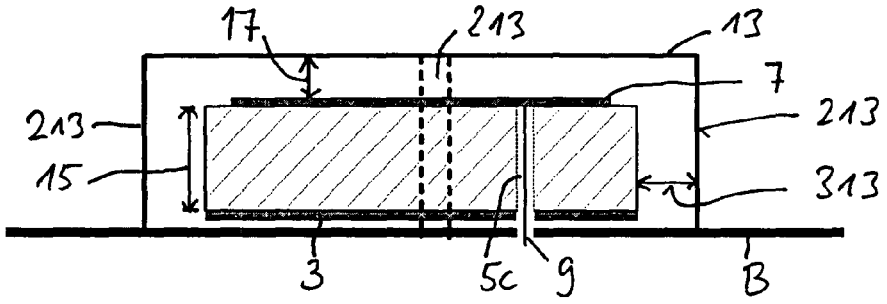
FIG. 3 shows a schematic transverse or lateral view of a tunable patch antenna according to an embodiment of the invention.

FIG. 1 shows a schematic lateral view and FIG. 2 a schematic plan view of the basic structure of a conventional commercial patch radiator A (patch antenna), which is extended with the aid of FIG. 3 et seq. into a tunable patch antenna.

The patch antenna shown in FIGS. 1 and 2 comprises a plurality of surfaces and layers arranged along an axis Z one above the other, which will be dealt with below.

It can be seen from the schematic cross-sectional view according to FIG. 1 that the patch antenna A has an electrically conductive ground surface 3 on its so-called lower or mounting side 1. Arranged on the ground surface 3 or with a lateral offset with respect thereto is a dielectric carrier 5, which generally has an outer contour 5' in plan view, which corresponds to the outer contour 3' of the ground surface 3. This dielectric carrier 5 may, however, also have larger or smaller dimensions and/or be provided with an outer contour 5' differing from the outer contour 3' of the ground surface 3. In general, the outer contour 3' of the ground surface may be n-polygonal and/or even be provided with curved portions or be curved in design, although this is not usual.

The dielectric carrier 5 has an adequate height or thickness, which generally corresponds to a multiple of the thickness of the ground surface 3. In contrast to the ground surface 3, which virtually consists only of a two-dimensional surface, the dielectric carrier 5 is designed as a three-dimensional body with adequate height and thickness.

Configured on the upper side 5*a* opposing the lower side 5*b* (which comes to rest adjacent to the ground surface 3) is an electrically conductive effective face 7, which can again also be taken to mean a virtually two-dimensional surface. This effective surface 7 is fed and excited electrically via a feed line 9, which preferably extends in the transverse direction, in particular vertically to the effective surface 7 from below through the dielectric carrier 5 in a corresponding bore or a corresponding channel 5*c*.

From a connection point 11, which is generally located at the bottom, to which a coaxial cable, not shown in more detail, can be connected, the internal conductor of the coaxial cable, not shown, is then electrically/galvanically connected to the feed line 9 and therefore to the effective surface 7. The external conductor of the coaxial cable, not shown, is then electrically/galvanically connected to the ground surface 3 located at the bottom.

In the embodiment according to FIG. 1 et seq., a patch antenna is described, which has a dielectric 5 and a square shape in plan view. This shape or the corresponding contour or outline 5' may, however, differ from the square shape and in general have an n-polygonal shape. Although unusual, curved outer limitations may even be provided.

The effective surface 7 seated on the dielectric 5 may have the same contour or outline 7' as the dielectric 5 located therebelow. In the embodiment shown, the basic shape is also square and adapted to the outline 5' of the dielectric 5, but has flattened areas 7" at two opposing ends, which are virtually formed by omitting an isosceles rectangular triangle. In general, the outline 7' may thus be an n-polygonal outline or contour or even be provided with a curved outer limitation 7'.

The ground surface 3 mentioned, as also the effective surface 7 are partially designated a "two-dimensional" surface, as their thickness is so small that they can virtually not be designated "volume bodies". The thickness of the ground surface and the effective surface 3, 7 is generally below 1 mm, i.e. generally below 0.5 mm, in particular below 0.25 mm, 0.20 mm, 0.10 mm.

Figure 4:
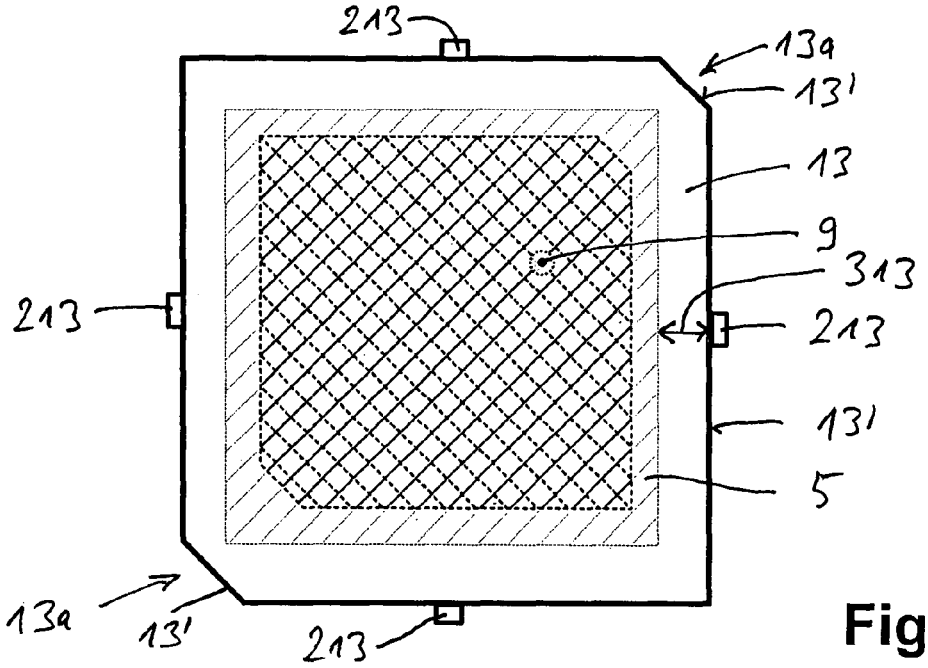
FIG. 4 shows a schematic plan view of the embodiment according to FIG. 3.

Arranged above the patch antenna A thus formed, which, for example, may consist of a conventional commercial patch antenna A, preferably of a so-called ceramic patch antenna (in which in other words, the dielectric carrier layer 5 consists of a ceramic material), is, in a patch antenna which can be tuned, according to the invention, according to FIGS. 3 and 4 with a lateral or height offset with respect to the upper effective surface 7, additionally a patch-like conductive structure 13 (FIG. 3).

The tunable patch antenna described in this way is, for example, positioned on a chassis B indicated in FIG. 3 merely as a line, which may, for example, be the base chassis for a motor vehicle antenna, in which the antenna according to the invention may optionally be installed next to further antennas for other services. The tunable patch antenna according to the invention may, for example, be used, in particular, as an antenna for the geostationary positioning and/or for the reception of satellite or terrestrial signals, for example of the so-called SDARS service. Limitations to the use even for other services are not provided, however.

The patch-like conductive structure 13 may, for example, consist of an electrically conductive metal body, in other words, for example, a metal sheet with corresponding longitudinal and/or transverse extension or, in general, of an electrically conductive layer, which is configured on a correspondingly dimensioned substrate (for example in the form of an electric body or a dielectric board similar to a printed-circuit board).

As emerges from the plan view, according to FIG. 4, this patch element 13 may, however, also have an outline 13' differing from a rectangular or square structure. As is known, in fact, by machining off edge regions, for example corner regions 13*a* which can be seen in FIG. 4, a certain adaptation of the patch antenna can be carried out.

In the embodiment shown, the patch-like conductive structure 13 has a longitudinal extension and a transverse extension, which, on the one hand, is greater than the longitudinal and transverse extension of the effective surface 7 and/or, on the other hand, is greater than the longitudinal and transverse extension of the dielectric carrier 5 and/or the ground surface 3 located therebelow.

Figure 5:
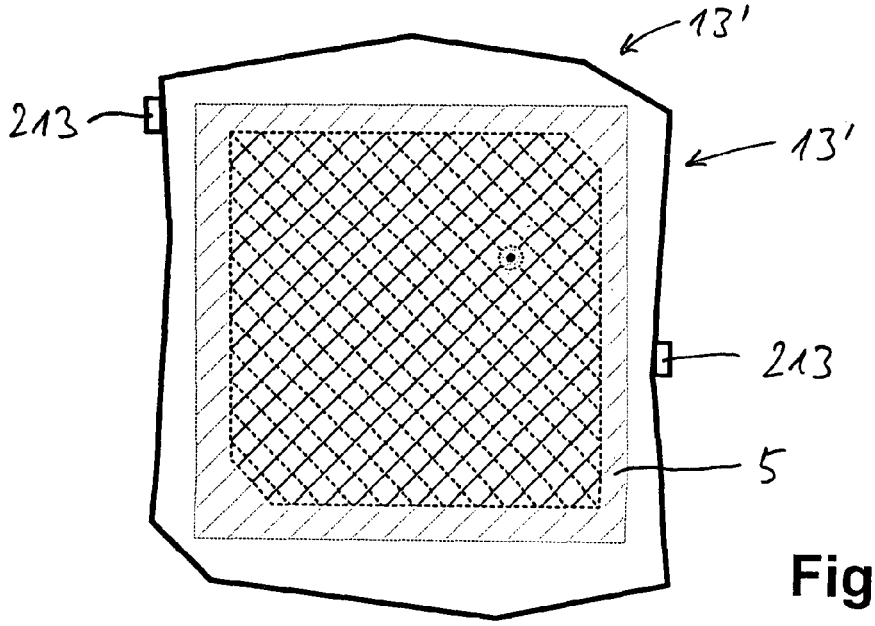
FIG. 5 shows a plan view of a patch antenna according to the invention with an embodiment differing from FIG. 4 for the patch element seated at the top.

In general, the patch-like conductive structure 13 may also completely or partially have convex or concave and/or other curved outlines or an n-polygonal outline or mixtures of the two, as is shown only schematically for a differing embodiment according to FIG. 5 in plan view, the patch element 13 in this case having an irregular outer contour or an irregular outline 13'.

As can be seen from FIG. 3, the patch-like conductive structure 13 is arranged at a spacing 17 above the effective surface 7. This spacing may be selected in further areas. In this case, the spacing 17 should, if possible, be no smaller than 0.5 mm, preferably more than 0.6 mm, 0.7 mm, 0.8 mm, 0.9 mm or equal to or more than 1 mm. Values around 1.5 mm, in other words in general between 1 mm to 2 mm or 1 mm to 3 mm, 4 mm or up to 5 mm are completely adequate.

On the other hand, it is also to be seen that the spacing 17 of the patch-like conductive structure 13 is preferably smaller than the height or thickness 15 of the dielectric carrier 5. The spacing 17 of the topmost conductive structure 13 preferably has a measurement which corresponds to less than 90%, in particular less than 80%, 70%, 60%, 50% or even less than 40% and optionally 30% or less than 20% of the height or thickness 15 of the carrier element 5.

As can be seen from FIGS. 3 to 5, in the embodiment selected using a plate-shaped electrically conductive structure 13, which is arranged with its plane preferably parallel to the chassis B or to the ground surface 3 and/or to the effective surface 7 on the side of the effective surface 7 opposing the ground surface 3, the electrically conductive structure 13 is held by means of support feet 213. In the embodiment shown, arranged in this case, in plan view lying offset in the peripheral direction, is in each case, a support foot 213 per longitudinal side 13*a*, which, in the embodiment shown, extends transversely to the ground surface or base surface of the chassis B, even perpendicularly to the embodiment shown. In this case, according to the embodiment shown, it is assumed that the ground surface 3 of the patch antenna A is galvanically or capacitively connected to a chassis ground surface B.

The support feet 213 thus preferably consist of an electrically conductive material. In particular if the patch-like electrically conductive structure 13 is produced from a metal sheet by cutting and/or stamping, corresponding support feet can also be configured at the outer periphery, which then extend by means of canting transversely to the surface of the patch-like conductive structure 13 and can then be electrically contacted and mechanically anchored with their free end 213*a* on the ground surface 3, B.

As the conductive structure 13 is larger in dimension in the longitudinal and transverse direction in the embodiment shown than the longitudinal and transverse direction of the patch antenna located therebelow, the feet can thus run perpendicularly to the ground surface 3 or chassis ground surface B past the patch antenna A with a lateral offset 313 thereto.

However, less or more feet may also be used or the feet may be connected or set at another point of the conductive structure 13.

It is shown, for this purpose, in FIG. 5 that, in this embodiment, only two obliquely opposing support feet 213 are used.

Instead of the electrically fully conductive support feet 213, plastics material bodies may also be used, for example, however, for the support feet 213, which are possibly provided with an electrically conductive upper or lower side or surface in general, namely by applying an electrically conductive outer layer. A substrate or a dielectric body can therefore be provided in parallel above the effective surface 7 and is supplemented, for example, with corresponding support feet or is provided in one piece by the producer, in other words this structure consists of a non-conductive material and is then covered with a correspondingly conductive layer or metal layer.

Figure 6:
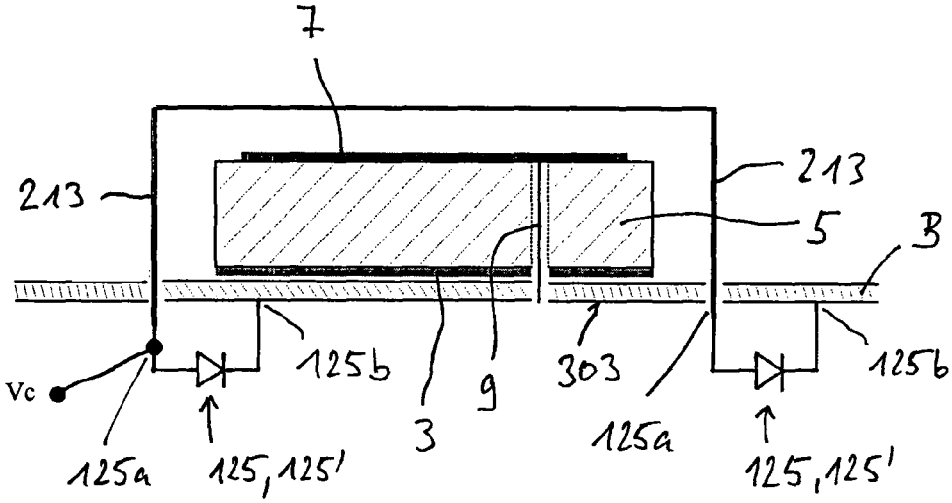
FIG. 6 shows a lateral or cross-sectional view of the patch antenna according to an embodiment of the invention corresponding to FIG. 3 reproducing a carrying device used for the upper patch element.

It is shown with the aid of FIG. 6 that, for example, the support feet covered with an electrically conductive layer or equipped with a separate parallel wire or other lines, or which are conductive per se, can be connected with the interposition of electric components 125 to an electrically conductive ground or base surface, in particular in the form of a chassis B.

In the embodiment shown according to FIG. 6 varactor diodes 125' are provided for this purpose. The electrically conductive support feet are guided without production of the electrically galvanic contact in this embodiment by corresponding bores through the ground surface 3 or in the chassis B, connected electrically galvanically at their free end to the electric components 125 mentioned, for example in the form of varactor diodes 125', for example on the connection side 125*a*, whereas the second connection side 125*b* is then connected to the ground surface 3 or B.

This provides the possibility of changing or adjusting the capacitance in a current-controlled manner, so the patch antenna thus formed can be tuned with respect to its frequency. Quite generally, the property of the antenna can be influenced thereby.

Figure 6A:
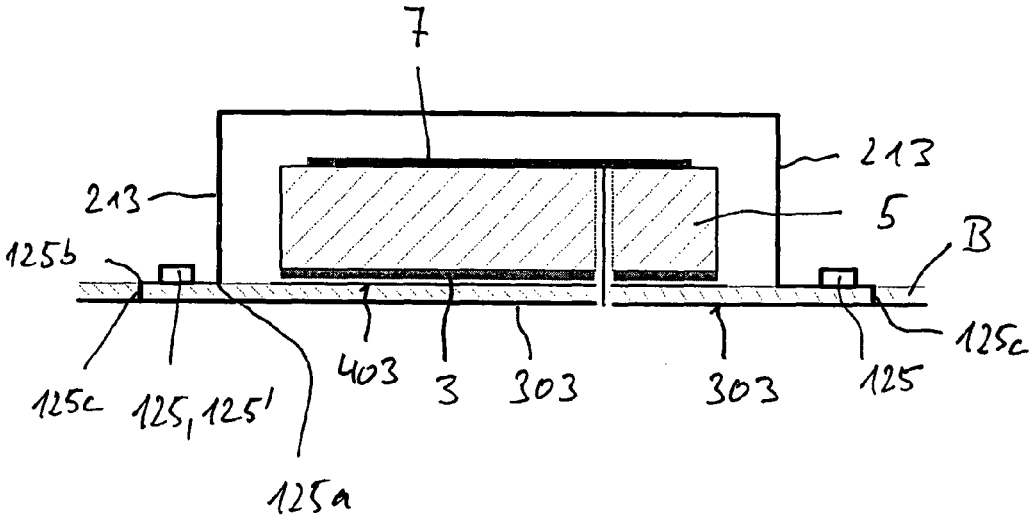
FIG. 6*a* shows a modified embodiment from FIG. 3.

Basically, for example, the ground surface or the chassis B could not consist, for example, of an electrically conductive material, but for example of a printed-circuit board (dielectric). This could, for example, be partially metallized on the lower side or, as will be dealt with below, on the upper side, in other words on the side carrying the antenna and optionally equipped with additional components, in particular SMD components, for example in the form of the varactor diode 125, 125'. For this purpose, the electrically conductive foot 213 (or an electrically conductive track or generally a line configured on the foot 213), in FIG. 6*a*, is connected on the radiator upper side of the base preferably configured in the form of a printed-circuit board B to an electric component 125, in particular an SMD component 125 on the connection side 125*a*, the other connection side 125*b* of which being connected via a through-plating 125*c* to the ground surface 303 configured on the lower side of the printed-circuit board B, electrically, preferably electrically/galvanically.

Likewise—as shown with the aid of FIG. 6—these components 125 could obviously just as well be provided or fitted on the lower side of the printed-circuit board. The support feet 213 could also be galvanically contacted here, for example on the upper side of the printed-circuit board, electrically/galvanically, for example by soldering to an electrically conductive intermediate face, and connected by means of through-platings 125*c* to the components 125 provided on the lower side of the printed-circuit board.

Moreover, it is shown with the aid of FIG. 6*a* that, for example, below the patch 3, in other words on the upper side of the chassis configured for example as a printed-circuit board B, a metallized layer 403 (for example a copper coating) may be provided. This layer could be electrically/galvanically connected with through-platings (not drawn in FIG. 6*a*) to the lower ground surface 303 (in other words on the lower side of the printed-circuit board B) to thus improve the capacitive coupling of the patch 3 to ground. Likewise, this metallized layer 403 in FIG. 6*a* could also go to the left and right to beyond the SMD components 125 (obviously without being electrically/galvanically connected to the connection side 125*a*).

Figure 7:
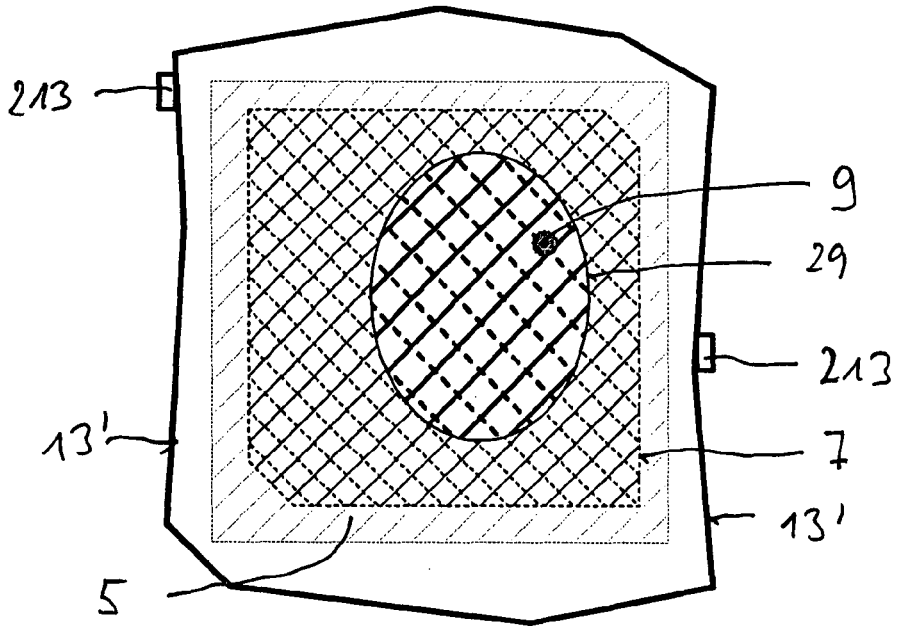
FIG. 7 shows an embodiment modified again of an antenna according to an embodiment of the invention with a hole-shaped recess in an electrical structure located above the patch antenna.

With the aid of FIG. 7, it is shown in a schematic plan view that the patch-like conductive structure 13 described, for example, with the aid of FIG. 5, can be connected to a recess or a hole 29. This recess or this hole 29 is preferably provided in the region in which the feed line 9 is connected to the effective surface 7 generally by soldering, for at this point, a soldering elevation 31 projecting over the surface of the effective surface 7 is generally configured (as can be seen with the aid of FIG. 8 for a further modified embodiment). Even if only a very small spacing 17 is provided between the conductive structure 13 and the adjacent effective surface 7, it is ensured thereby that no electrical contacting between a soldering elevation 31 and the conductive structure 13 is provided with the generally conventional commercial patch antenna located therebelow, this soldering elevation 31 generally being configured in the upper end of the feed line 9 at the effective surface 7.

Figure 8:
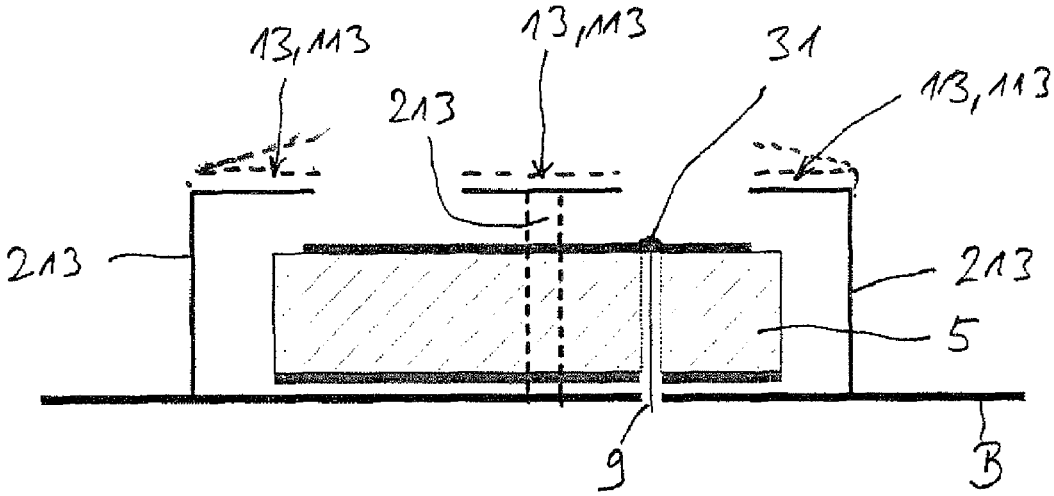
FIG. 8 shows an embodiment modified again with a plurality of electrical structures separated from one another in a lateral cross-sectional view.
Figure 9:
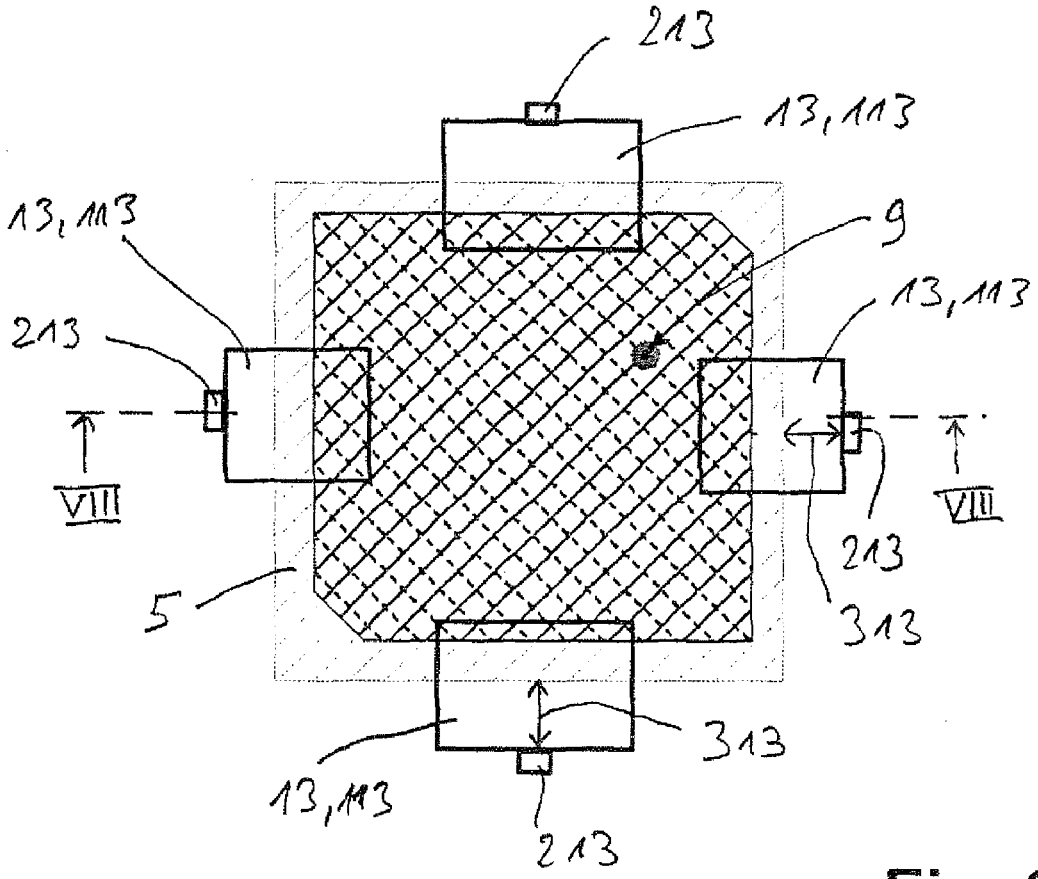
FIG. 9 shows a plan view of the embodiment according to FIG. 8.

A further embodiment will be described below with the aid of FIGS. 8 and 9, FIG. 8 showing a schematic lateral view along the section line VIII-VIII in FIG. 9 and FIG. 9 showing a schematic plan view of the modified embodiment.

This embodiment differs from the preceding embodiments in that a uniform common electrically conductive structure 13 is not configured, but a plurality of electrically conductive structures 13, which have a flat design. In the embodiment shown, the patch-like electrically conductive structural elements 113 are arranged in a common plane parallel to the adjacent effective surface 7 and parallel to the ground surface 3 and/or parallel to the chassis surface B. However, they can optionally be at different height levels. These structural elements do not inevitably have to be located parallel to one another or to the effective surface and ground surface, but optionally also enclose at least small angles of inclination with respect to one another.

Each electrically conductive structural element 13, 113 of this type is carried by means of a support foot 113 associated with it, held and preferably electrically connected, if no separate electric line is provided as a connection line to the ground surface (optionally with interposition of the mentioned electric components).

In this embodiment, the support feet 213 are also arranged laterally at a spacing 313 with respect to the patch antenna A, the electrically conductive structural elements 113, in a plan view of the upper effective surface 7, covering this at least partially. The structural elements 113 may have a longitudinal extension in this case, which is significantly shorter than the relevant side lengths of the effective surface 7, so these structural elements formed in this manner only cover the effective surface 7 with a comparatively small surface portion.

In the embodiment according to FIGS. 8 and 9, a support foot 213 is configured on the peripheral edge 113' of the electrically conductive structure 13, 113 and is, for example, mechanically and/or electrically connected to the electrically conductive structure 13, 113.

As the embodiment according to FIGS. 8 and 9 shows, each structural element 13, 113 which is electrically conductive or covered with an electrically conductive layer, has a length, which is preferably between 5 and 95%, in particular 10% and 90% and can adopt any intermediate value therein. A preferred length range corresponds to about 10% to 60%, in particular 20% to 50% of the corresponding length of the patch antenna A and/or the effective surface 7 located at the top. In the embodiment according to FIG. 9, it can be seen here, for example, that the longitudinal extension, in each case measured in the parallel direction of the relevant longitudinal extension of the patch element with regard to the structural element 113 located at the top and bottom in FIG. 9, is greater than the longitudinal extension of the patch element located to the left and right in FIG. 9. A desired fine tuning can also be carried out by this.

The respective transverse extension of the structural elements 13, 113 in FIGS. 8 and 9 in the covering direction to the patch antenna A is in the same order of magnitude as preferably between 10% to 90% and 20% to 60%, for example about 30% to 50% or 30% to 40%. Thus, the proportion of the surface of the structural element 113, which in the plan view according to FIG. 9 covers the patch antenna A with its dielectric should preferably be at least more than 20%, in particular more than 30% or 40% or 50% of the surface of the structural element 113. The proportion of the surface of the structural element in plan view according to FIG. 9, which covers the upper effective surface, should at least be more than 5%, in particular more than 10%, 20% or preferably 30% of the surface of the corresponding patch element 113 according to the plan view of FIG. 9.

Figure 10:
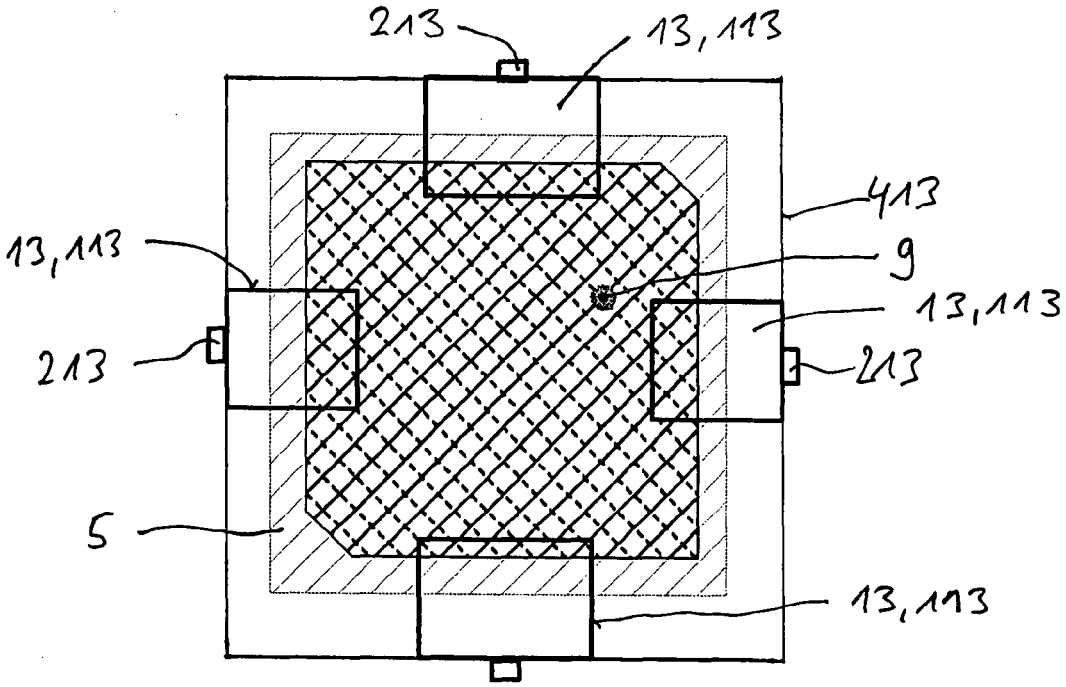
FIG. 10 shows a plan view comparable to the embodiment according to FIGS. 8 and 9, but with a modification.

The embodiment according to FIG. 10 basically corresponds to that according to FIG. 9. The only difference is that the conductive structures 13, 113 shown in FIG. 9 are not configured as mechanically independent electrically conductive structures, but as electrically conductive surfaces on an electrically non-conductive substrate, in particular in the form of a dielectric board, for example in the form of a so-called printed-circuit board. This dielectric carrier material or this dielectric substrate is provided with the reference numeral 413. This substrate 413 is also again supported mechanically by four feet, namely by a foot 213 on each side, wherein the electric connection of the electric structural element 13, 113 on the printed-circuit board-shaped substrate 413 can be electrically connected in the same manner to the ground potential, as is explained with the aid of FIG. 9 and the preceding examples.

The invention claimed is:

1. A tunable planar half-wave patch antenna, comprising a plurality of layers arranged along an axis (Z) with or without a lateral offset with respect to one another, comprising:

an electrically conductive ground surface, a dielectric carrier provided on the electrically conductive ground surface, said dielectric carrier having an upper side, and also having a lower side facing the ground surface, a conductive effective surface provided on the upper side of the dielectric carrier, the conductive effective surface being electrically connected to an electrically conductive feed line, an electrically conductive structure arranged, in relation to the ground surface, on the opposing side of the effective surface with a lateral spacing with respect thereto, the electrically conductive structure at least partially covering the conductive effective surface in plan view perpendicular to the effective surface, a carrying device holding the electrically conductive structure at a lateral spacing with respect to the effective surface, and the electrically conductive structure being galvanically or capacitively or serially connected, with interposition of at least one electric component, to the ground surface or a chassis located on a potential or ground, wherein the dielectric carrier occupies the space between the ground surface and the electrically conductive structure so the electrically conductive structure completely covers the effective surface and there is no air-filled cavity between the conductive effective surface and the ground surface.

2. The antenna as claimed in claim 1, wherein the carrying device comprises at least one carrying foot, which carries the electrically conductive structure relative to the ground surface or a ground potential or chassis.

3. The antenna as claimed in claim 2, wherein the carrying foot providing electrical conductivity.

4. The antenna as claimed in claim 2, wherein the carrying foot is electrically non-conductive dielectric, and the electrically conductive structure is connected to the ground potential via a further conductor.

5. The antenna as claimed in claim 1, wherein the electrically conductive structure comprises a uniform connected surface.

6. The antenna as claimed in claim 1, wherein the electrically conductive structure defines at least one recess, surrounded in the form of a frame by an electrically conductive surface.

7. The antenna as claimed in claim 1, wherein the electrically conductive structure has at least one of a maximum longitudinal extension and a maximum transverse extension, which is greater than or equal to the corresponding maximum longitudinal or transverse extension of at least one of the dielectric carrier and the ground surface.

8. The antenna as claimed in claim 1, further comprising a plurality of electrically conductive structures, which cover, in a patchwork, associated portions of the electrically conductive surface in a perpendicular plan view of the conductive effective surface.

9. The antenna as claimed in claim 8, wherein the conductive structure has plural sides, and said patch antenna further comprises at least one structural element provided on each side thereof and at least one support foot holding said structure elements.

10. The antenna as claimed in claim 8, wherein the plurality of structural elements are arranged at the same height level with the same lateral spacing with respect to the effective surface and parallel thereto.

11. The antenna as claimed in claim 8, wherein the plurality of structural elements are arranged at different height levels at a different lateral spacing with respect to the effective surface.

12. The antenna as claimed in claim 8, wherein the plurality of structural elements are arranged at different angles of inclination with respect to one another.

13. The antenna as claimed in claim 1, further including an electrical component that connects the electrically conductive structure to a ground potential.

14. The antenna as claimed in claim 13, wherein the electrical component consists of a varactor diode, via which different capacitances can be adjusted in a current-controlled manner for frequency tuning of the antenna arrangement.

15. The antenna as claimed in claim 1, wherein the electrically conductive structure is arranged at a spacing above the effective surface, the spacing being greater than 0.5 mm.

16. The antenna as claimed in claim 15, wherein the spacing is less than 5 mm.

17. The antenna as claimed in claim 1, wherein the electrically conductive structure is arranged at a spacing above the effective surface, which is at least 10% of the thickness of the dielectric carrying device.

18. The antenna as claimed in claim 1, wherein the electrically conductive structure is arranged at a spacing above the effective surface, which corresponds to less than 60% of the height of the dielectric carrying device.

19. The antenna as claimed in claim 1, wherein the at least one carrying foot is aligned perpendicularly with the surface of the electrically conductive structure and/or perpendicularly to the ground surface.

20. The antenna as claimed in claim 1, wherein the at least one carrying foot is aligned at an angle deviating from the perpendicular to the surface of the electrically conductive structure and/or at an angle deviating from the perpendicular to the ground surface.

21. The antenna as claimed in claim 1, wherein the electrically conductive structure comprises a leaf-shaped, sheet-shaped or plate-shaped base portion, in the form of a dielectric substrate.

22. The antenna as claimed in claim 1, further including a plurality of electrically conductive structures or structural elements configured as a patchwork of electrically conductive surfaces on a dielectric substrate.

23. The antenna as claimed in claim 1, wherein the electrically conductive structure consists of an electrically conductive material.

24. The antenna as claimed in claim 1, wherein carrying feet are configured at the peripheral edge of the central or base portion of the electrically conductive structure.

25. The antenna as claimed in claim 1, wherein the electrically conductive structure consists of a metal sheet having carrying feet formed by cutting or stamping and subsequent canting.

26. The antenna as claimed in claim 13, wherein the electric component is arranged on the side of the conductive ground surface on which the patch antenna is also arranged.

27. The antenna as claimed in claim 26, wherein configured on the side of a printed-circuit board opposing the patch antenna is a ground surface, and the electric component is connected to this ground surface by means of a through-plating.

28. The antenna as claimed in claim 13, wherein the electric component is arranged on the lower side of a circuit board or a chassis, the one connection point of which is connected to the electrically conductive structure and the other connection is connected to a ground potential.

29. A tunable planar unshorted patch antenna, comprising a plurality of layers arranged along an axis (Z) with or without a lateral offset with respect to one another, comprising:

an electrically conductive ground surface, a dielectric carrier provided on the electrically conductive ground surface, said dielectric carrier having an upper side, and also having a lower side facing the ground surface, a conductive effective surface provided on the upper side of the dielectric carrier, the conductive effective surface being electrically connected to an electrically conductive feed line and not being shorted to said electrically conductive ground surface, a patch-like electrically conductive structure arranged, in relation to the ground surface, on the opposing side of the effective surface with a lateral spacing with respect thereto, the patch-like electrically conductive structure at least partially covering the conductive effective surface in plan view perpendicular to the effective surface, a carrying device holding the electrically conductive structure at a lateral spacing with respect to the effective surface, and the patch-like electrically conductive structure being galvanically or capacitively or serially connected, with interposition of at least one electric component, to the ground surface or a chassis located on a potential or ground, wherein the dielectric carrier occupies the space between the ground surface and the electrically conductive structure so the electrically conductive structure completely covers the effective surface and there is no air-filled cavity between the conductive effective surface and the ground surface.

* * * * *